US011004404B2

(12) United States Patent
Lee et al.

(10) Patent No.: US 11,004,404 B2
(45) Date of Patent: May 11, 2021

(54) IMAGE DATA PROCESSING APPARATUS AND DISPLAY DEVICE FOR REDUCING POWER CONSUMPTION OF BACKLIGHT

(71) Applicant: SILICON WORKS CO., LTD., Daejeon (KR)

(72) Inventors: Do Hoon Lee, Daejeon (KR); Heung Lyeol Lee, Daejeon (KR); Kyung Jin Park, Daejeon (KR)

(73) Assignee: Silicon Works Co., Ltd., Daejeon (KR)

( * ) Notice: Subject to any disclaimer, the term of this patent is extended or adjusted under 35 U.S.C. 154(b) by 0 days.

(21) Appl. No.: 16/717,960

(22) Filed: Dec. 17, 2019

(65) Prior Publication Data

US 2020/0202801 A1 Jun. 25, 2020

(30) Foreign Application Priority Data

Dec. 20, 2018 (KR) ..... 10-2018-0166218

(51) Int. Cl.
*G09G 3/36* (2006.01)
*G09G 3/34* (2006.01)

(52) U.S. Cl.
CPC ..... *G09G 3/3406* (2013.01); *G09G 3/3685* (2013.01); *G09G 2320/0233* (2013.01); *G09G 2320/0633* (2013.01); *G09G 2320/0673* (2013.01); *G09G 2330/023* (2013.01); *G09G 2360/16* (2013.01)

(58) Field of Classification Search
CPC ... G09G 2320/0276; G09G 2320/0646; G09G 2360/16; G09G 2320/064; G09G 3/2011; G09G 3/3406; G09G 2360/144; G09G 2320/0606; G09G 2320/0238; G09G 2330/021; G09G 2320/066; G09G 2320/0626; G09G 2320/0673; G09G 5/10; G09G 3/36; G09G 3/3413; G09G 2320/0233; G09G 3/342; G09G 2320/062; G09G 2360/147
USPC ..... 345/102
See application file for complete search history.

(56) References Cited

U.S. PATENT DOCUMENTS

| | | | | |
|---|---|---|---|---|
| 7,961,199 | B2 | 6/2011 | Kerofsky et al. | |
| 9,454,937 | B2 * | 9/2016 | Kim | G09G 3/3607 |
| 9,911,387 | B2 * | 3/2018 | Kim | G09G 3/3607 |
| 10,417,973 | B2 * | 9/2019 | Kawaguchi | G09G 3/3406 |
| 2012/0162532 | A1 * | 6/2012 | Oniki | H04N 5/202 348/725 |

(Continued)

FOREIGN PATENT DOCUMENTS

| | | |
|---|---|---|
| KR | 10-1289653 B1 | 7/2013 |
| KR | 10-1723496 B1 | 3/2017 |

*Primary Examiner* — Duc Q Dinh
(74) *Attorney, Agent, or Firm* — Fenwick & West LLP

(57) ABSTRACT

According to an embodiment, the representative brightness value of image data is determined through an analysis of the image data, the dimming value of a backlight is adjusted according to the representative brightness value, and the image data is converted so as to correspond to the adjusted dimming value such that pixels maintain original brightness. In order to simplify the image data conversion, a characteristic value may be generated according to the adjusted dimming value, and a gamma curve may be generated on the basis of the characteristic value, thereby converting the image data.

13 Claims, 9 Drawing Sheets

(56) References Cited

U.S. PATENT DOCUMENTS

2013/0093656 A1* 4/2013 Wang ..... G09G 3/2003
345/88
2014/0267466 A1* 9/2014 Takagi ..... G09G 3/36
345/691
2014/0320552 A1* 10/2014 Seo ..... G09G 3/3648
345/690

* cited by examiner

IMAGE DATA PROCESSING APPARATUS AND DISPLAY DEVICE FOR REDUCING POWER CONSUMPTION OF BACKLIGHT

CROSS REFERENCE TO RELATED APPLICATION

This application claims priority from Korean Patent Application No. 10-2018-0166218, filed on Dec. 20, 2018, which is hereby incorporated by reference for all purposes as if fully set forth herein.

BACKGROUND OF THE INVENTION

1. Field of the Invention

The present embodiment relates to a display technology for reducing power consumed by a backlight.

2. Description of the Prior Art

Among various components constituting an electronic device, it is the display device that consumes the largest amount of power. The display device is continuously turned on while providing information to the user, and needs to continuously output light when turned on, thereby consuming more power than any other components of the electronic device.

For this reason, electronic device manufacturers have continued research/development to reduce the amount of power consumed by display devices. Typical examples thereof include technologies for switching display devices to a standby mode or turning on only a part of the display panel.

However, such technologies inevitably inconvenience users to some extent because the amount of power consumed by display devices is reduced by substantially restricting the user environment constantly.

Meanwhile, there has been ongoing development regarding a technology capable of reducing the amount of power consumed by display devices without changing the user environment or while involving an environment change to such an extent that users can hardly recognize the same. Contents adaptive brightness control (CABC) technology is a typical example thereof.

According to the CABC technology, the brightness of the backlight of a display device is decreased according to image data, and the grayscale of each pixel is increased to compensate for the decreased backlight brightness. The CABC technology can reduce the amount of power consumed by the display device because the brightness of the backlight is decreased while providing the user with images similar or substantially identical to the original images.

However, a display device to which the CABC technology is applied has a problem in that, in connection with increasing the grayscale of each pixel as much as the decreased brightness of the display device, the process of compensating for the grayscale of each pixel is complicated because the pixels have nonlinear brightness characteristics.

SUMMARY OF THE INVENTION

In this background, an aspect of the present embodiment is to provide a technology for simplifying the process of converting image data in connection with the CABC technology.

According to an embodiment, there is provided an image data processing device including: an image analysis unit configured to calculate a representative brightness value of multiple pixels by analyzing original image data regarding the multiple pixels; a dimming control unit configured to calculate an adjusted dimming value of a backlight according to the representative brightness value; a gamma conversion unit configured to calculate at least one characteristic value constituting a gamma curve according to the adjusted dimming value and to generate converted image data regarding the original image data by using the gamma curve; a data output unit configured to output the converted image data to a data driving device configured to drive the multiple pixels; and a dimming output unit configured to output an adjusted dimming control signal to a backlight driving device according to the adjusted dimming value.

In connection with the image data processing device, the at least one characteristic value may be coordinate values of major inflection points of the gamma curve, and the gamma curve may consist of straight lines or curved lines connecting the coordinate values.

In connection with the image data processing device, the gamma conversion unit may be configured to store multiple characteristic value sets corresponding to multiple reference dimming values and to calculate the at least one characteristic value corresponding to the adjusted dimming value by applying an interpolation formula to the multiple reference dimming values and the multiple characteristic value sets.

The image data processing device may further include a dimming analysis unit configured to receive a pre-adjustment dimming control signal from outside and to check a pulse width modulation (PWM) cycle or frequency of the pre-adjustment dimming control signal, and the dimming output unit may be configured to control a PWM cycle or frequency of the adjusted dimming control signal so as to match with the PWM cycle or frequency of the pre-adjustment dimming control signal.

In connection with the image data processing device, the lower the adjusted dimming value, the lower the brightness of the backlight, and the lower the adjusted dimming value, the larger the curvature of the gamma curve regarding the at least one characteristic value.

In connection with the image data processing device, the image analysis unit may be configured to calculate a pixel brightness value having a weighted green (G) component through an analysis of the original image data and to calculate the representative brightness value according to the pixel brightness value.

In connection with the image data processing device, the image analysis unit may be configured to calculate the representative brightness value by using a cumulated density function (CDF) or average pixel level (APL) method.

In connection with the image data processing device, the image analysis unit may be configured to calculate a Y component (in a YUV colorspace) through an analysis of the original image data and to calculate the representative brightness value according to the value of the Y component.

In connection with the image data processing device, the dimming control unit may be configured to calculate a target dimming value according to the representative brightness value and to slowly change the adjusted dimming value such that the target dimming value is reached after a predetermined conversion time.

In connection with the image data processing device, the dimming control unit may be configured to calculate a first target dimming value as the target dimming value and to change the adjusted dimming value at a first rate of change such that the first target dimming value is reached after the predetermined conversion time, and to change, if the target dimming value is changed to a second target dimming value before the first target dimming value is reached, the adjusted dimming value at a second rate of change such that the second target dimming value is reached after the predetermined conversion time from the timepoint of change.

According to another embodiment, there is provided a display device including: a display panel having multiple pixels disposed thereon and having a backlight disposed in the background of the multiple pixels; a data driving device configured to drive the multiple pixels; a backlight driving device configured to drive the backlight and to control dimming of the backlight; and an image data processing device configured to calculate a representative brightness value of the multiple pixels by analyzing original image data regarding the multiple pixels, to calculate an adjusted dimming value of the backlight according to the representative brightness value, to calculate at least one characteristic value constituting a gamma curve according to the adjusted dimming value, to generate converted image data regarding the original image data by using the gamma curve, to output the converted image data to the data driving device, and to output an adjusted dimming control signal to the backlight driving device according to the adjusted dimming value.

In connection with the display device, the backlight driving device may be configured to perform a pulse width modulation (PWM) dimming, and the adjusted dimming control signal is a PWM signal.

The display device may further include a host device configured to transmit the original image data to the image data processing device and to transmit a pre-adjustment dimming control signal indicating a dimming value determined by user manipulation to the image data processing device.

In connection with the display device, the display panel may comprise liquid crystals respectively corresponding to pixels and the data driving device is configured to control the brightness of each pixel by adjusting the direction of each liquid crystal.

In connection with the display device, the at least one characteristic value may be a value corresponding to the curvature of the gamma curve.

As described above, according to the present embodiment, the process of converting image data can be simplified in connection with the CABC technology.

BRIEF DESCRIPTION OF THE DRAWINGS

The above and other aspects, features and advantages of the present disclosure will be more apparent from the following detailed description taken in conjunction with the accompanying drawings, in which.

DETAILED DESCRIPTION OF THE EXEMPLARY EMBODIMENTS

Figure 1:
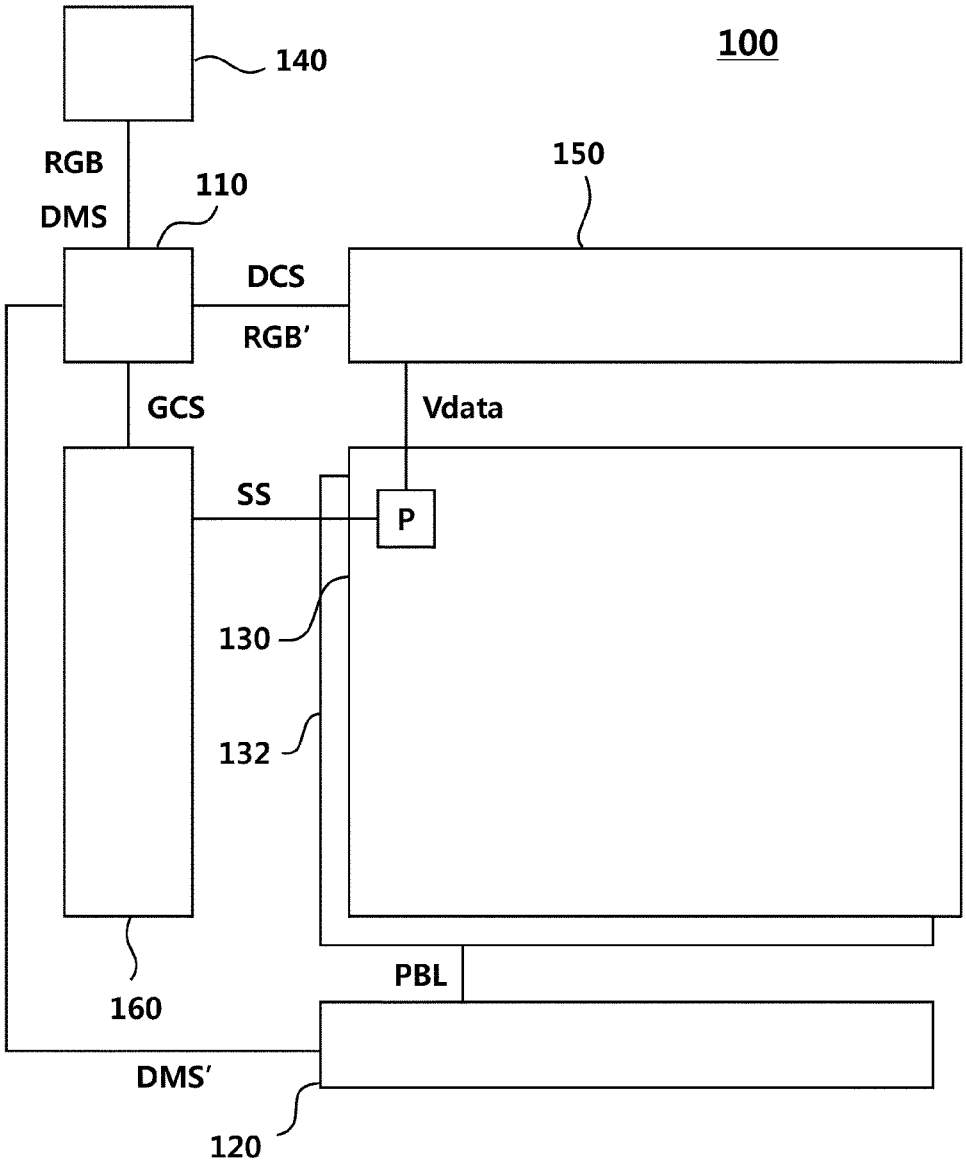
FIG. 1 is a diagram illustrating the configuration of a display device according to an embodiment.

Hereinafter, some embodiments of the present disclosure will be described in detail with reference to the accompanying drawings. In adding reference numerals to elements in each drawing, the same elements will be designated by the same reference numerals as far as possible, although they are shown in different drawings. Further, in the following description of the present disclosure, a detailed description of known functions and configurations incorporated herein will be omitted when it is determined that the description may make the subject matter of the present disclosure rather unclear.

In addition, terms, such as first, second, A, B, (a), (b) or the like may be used herein when describing components of the present disclosure. These terms are merely used to distinguish one structural element from other structural elements, and a property, an order, a sequence or the like of a corresponding structural element are not limited by the term. When it is described in the specification that one component is "connected," "coupled" or "joined" to another component, it should be read that the first component may be directly connected, coupled or joined to the second component, but also a third component may be "connected," "coupled," and "joined" between the first and second components.

FIG. 1 is a diagram illustrating the configuration of a display device according to an embodiment.

Referring to FIG. 1, the display device 100 may include a host device 140, an image data processing device 110, a data driving device 150, a gate driving device 160, a display panel 130, a backlight driving device 120, and the like.

The host device 140 may recognize a user manipulation and, according to the user manipulation, may generate image data or generate a dimming control signal.

Image data may be converted in various types inside the display device 100. In this connection, image data generated and transmitted by the host device 140 will hereinafter be referred to as original image data RGB, in order to be distinguished from converted image data, and image data generated and transmitted by the image data processing device 110 will be referred to as converted image data RGB'. In addition, a dimming value included in a dimming control signal may be adjusted inside the display device 100. In this regard, a dimming control signal generated and transmitted by the host device 140 will hereinafter be referred to as a pre-adjustment dimming control signal DMS, in order to be distinguished from an adjusted dimming control signal, and a dimming control signal generated and transmitted by the image data processing device 110 will be referred to as an adjusted dimming control signal DMS'.

From the viewpoint of signal flow, image data is generated by the host device 140, converted by the image data processing device 110, and then transmitted to the data driving device 150. In addition, a dimming control signal is generated by the host device 140, adjusted by the image data processing device 110, and then transmitted to the backlight driving device 120.

The image data processing device 110 is configured to convert the image data according to the CABC technology and to adjust the dimming control signal.

The image data processing device 110 may analyze original image data RGB regarding multiple pixels P disposed on the display panel 130, and may calculate a representative brightness value of the multiple pixels P. Since the multiple pixels P have different brightness values, the image data processing device 110 calculates a representative brightness value that can represent the multiple pixels P. The representative brightness value may be, for example, the average brightness value of the multiple pixels P. Alternatively, the representative brightness value may be, for example, the modal brightness value of the multiple pixels P or the maximum brightness value thereof. The image data processing device 110 may calculate the representative brightness value of the multiple pixels P by using a method known as a cumulated density function (CDF) or average pixel level (APL). The value calculated according to the above-mentioned method may be modified according to a predetermined configuration and then determined as the representative brightness value.

The image data processing device 110 may calculate an adjusted dimming value of the backlight 132 according to the representative brightness value. As used herein, the dimming value may be understood as a dimming brightness value. The higher the dimming value, the higher the brightness value of the backlight 132. For example, if the dimming value is 100%, the backlight 132 is driven with the maximum brightness, and if the dimming value is 0%, the backlight 132 is driven with the minimum brightness or is turned off.

The lower the representative brightness value, the lower the image data processing device 110 may make the adjusted dimming value. In other words, the lower the representative brightness value, the lower the image data processing device 110 may make the brightness of the backlight 132.

The image data processing device 110 may convert the original image data RGB in order to compensate for the greyscale of each pixel according to the adjusted dimming value. For example, the image data processing device 110 may convert the original image data RGB such that, the lower the adjusted dimming value, the higher the greyscale of each pixel. It can be understood in this regard that the higher the greyscale, the closer to a bright color.

Meanwhile, since each pixel has nonlinear brightness characteristics, the image data processing device 110 may convert the original image data RGB through nonlinear mapping. According to the prior art, image data is first converted from a nonlinear domain to a linear domain because each pixel has nonlinear brightness characteristics, the image data is multiplied by a gain in the linear domain so as to convert the image data, and the image data in the linear domain is converted back to the nonlinear domain. This process is complicated and needs to go through multiple steps, thereby posing the problem of an increased amount of calculation power.

The image data processing device 110 according to an embodiment may map the original image data RGB nonlinearly by using a gamma curve, thereby generating converted image data RGB'. Since the gamma curve itself has nonlinear characteristics reflected therein, the image data processing device 110 according to an embodiment can directly convert image data without going through a process of conversion between the nonlinear domain and the linear domain.

The image data processing device 110 may generate at least one characteristic value according to the adjusted dimming value, and may generate a gamma curve by using the at least one characteristic value. The gamma curve may be a nonlinear curve, and such a nonlinear curve may be specified by a curvature or by the coordinate value of a major inflection point. The curvature or the coordinate value of a major inflection point may be referred to as a characteristic value regarding the gamma curve. The image data processing device 110 may generate at least one characteristic value according to the adjusted dimming value, and may generate a gamma curve on the basis of the at least one characteristic value.

In addition, the image data processing device 110 may generate converted image data RGB' regarding the original image data RGB by using the gamma curve, and may output the converted image data RGB' to the data driving device 150 configured to drive multiple pixels P.

The image data processing device 110 may generate an adjusted dimming control signal DMS' according to the adjusted dimming value, and may output the adjusted dimming control signal DMS' to the backlight driving device 120.

Meanwhile, the display panel 130 may have multiple pixels P disposed thereon, and may have a data line and a gate line disposed thereon and connected to the multiple pixels P. The gate driving device 160 may transmit a scan signal SS through the gate line so as to connect each pixel P and the data line, and the data driving device 150 may supply a data voltage Vdata corresponding to the converted image data RGB' through the data line so as to drive each pixel P.

The image data processing device 110 may transmit a gate control signal GCS to the gate driving device 160 and may transmit a data control signal DCS to the data driving device 150, thereby controlling the driving timing related to each pixel P. In this aspect, the gate driving device 160 may be referred to as a gate driver GD-IC, the data driving device 150 may be referred to as a source driver SD-IC, and the image data processing device 110 may be referred to as a timing controller TCON.

The backlight 132 may be disposed in the background of the display panel 130, and the backlight 132 may be driven by the backlight driving device 120.

The backlight driving device 120 may control the brightness of light sources constituting the backlight 132. The light sources may be, for example, of a fluorescent lamp (FL) series or of a light-emitting diode (LED) series.

The backlight driving device 120 may dimming-control the backlight 132. For example, the backlight driving device 120 may continuously drive the backlight 132 while reducing the amount of power PBL supplied to the backlight 132, thereby dimming-controlling the backlight 132. As another example, the backlight driving device 120 may discontinuously drive the backlight 132 while adjusting the ratio between the turn-on time and the turn-off time, thereby dimming-controlling the backlight 132.

The dimming control signals DMS and DMS' may be of an analog voltage type or an analog current type, or the dimming control signals DMS and DMS' may be of a PMS signal type.

Figure 2:
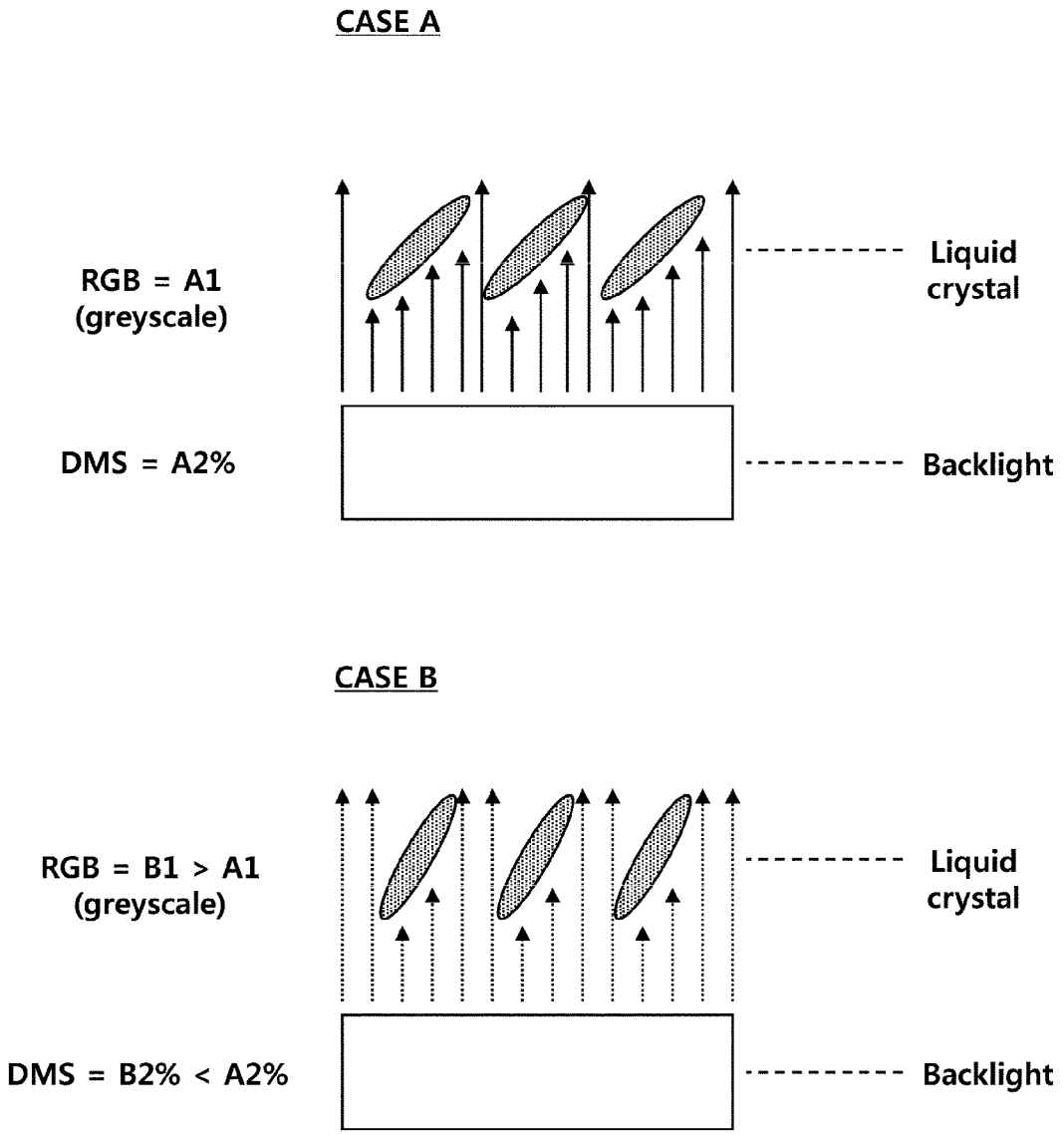
FIG. 2 is a diagram illustrating the principle of a CABC technique which can be applied to a display device according to an embodiment.

FIG. 2 is a diagram illustrating the principle of a CABC technique which can be applied to a display device according to an embodiment.

The display device according to an embodiment may drive each pixel with the same brightness in CASE A and CASE B.

The display panel of the display device may include a liquid crystal corresponding to each pixel. A backlight may be disposed on the background of the liquid crystals. The display device may adjust the direction of the liquid crystals to control the brightness of light delivered from the backlight to the user's eyes. For example, if the liquid crystals block less light from the backlight as in CASE B, a higher proportion of light is delivered from the backlight to the user's eyes, and if the liquid crystals block more light from the backlight as in CASE A, a lower proportion of light is delivered from the backlight to the user's eyes.

The display device may cause the liquid crystals to cover the backlight more when the backlight has a high brightness as in CASE A or cause the liquid crystals to cover the backlight less when the backlight has a low brightness as in CASE B, thereby maintaining the brightness of the pixels at the same level. In this case, the dimming value B2 in CASE B is smaller than the dimming value A2 in CASE A, and the grayscale B1 in CASE B is higher than the grayscale A1 in CASE A.

The display device can reduce the amount of power consumption by changing the state in CASE A to the state in CASE B.

Figure 3:
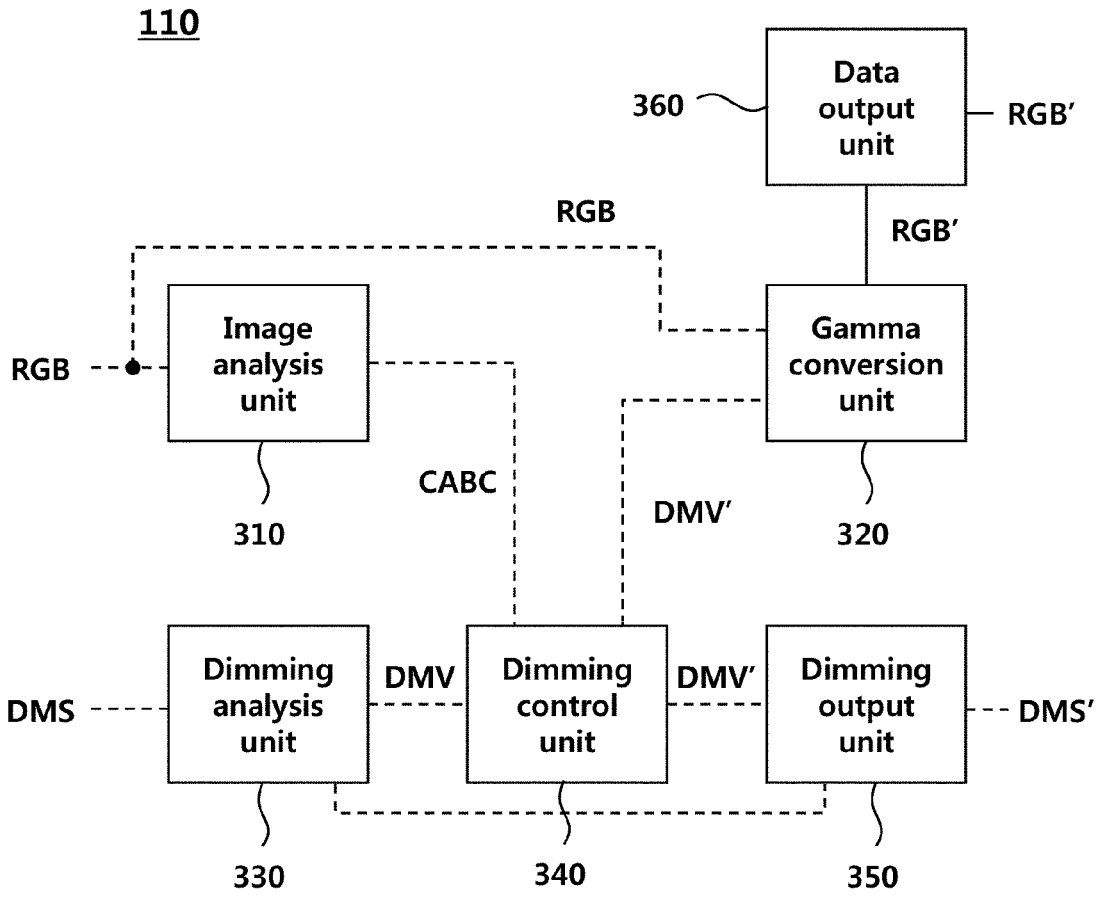
FIG. 3 is a diagram illustrating the configuration of an image data processing device according to an embodiment.

FIG. 3 is a diagram illustrating the configuration of an image data processing device according to an embodiment.

Referring to FIG. 3, the image data processing device 110 may include an image analysis unit 310, a gamma conversion unit 320, a dimming analysis unit 330, a dimming control unit 340, a dimming output unit 350, a data output unit 360, and the like.

The image analysis unit 310 may analyze original image data RGB regarding multiple pixels so as to calculate a CABC value CABC of the multiple pixels. The CABC value CABC is determined according to the representative brightness value, and may be a value corresponding to the representative brightness value or a value obtained by modifying the representative brightness value according to a predetermined configuration.

The dimming control unit 340 may calculate an adjusted dimming value DMV' of the backlight according to the CABC value CABC.

The dimming control unit 340 may slowly change the dimming value. If the dimming value changes abruptly, the user may sense an abnormal phenomenon, such as a flicker. The dimming control unit 340 may calculate a target dimming value according to the CABC value CABC, and may slowly change the adjusted dimming value such that the target dimming value is reached after a predetermined conversion time.

The pre-adjustment dimming value needs to be checked in order to slowly change the dimming value, and the dimming control unit 340 may receive the pre-adjustment dimming value DMV from the dimming analysis unit 330.

The dimming analysis unit 330 may receive a pre-adjustment dimming control signal DMS and may analysis the pre-adjustment dimming control signal DMS, thereby checking the pre-adjustment dimming value DMV. For example, if the dimming control signal DMS or DMS' is a PWM signal, the dimming analysis unit 330 may check the PWM cycle, frequency, duty, and the like of the pre-adjustment dimming control signal DMS, thereby checking the pre-adjustment dimming value DMV.

The dimming control unit 340 may compare the pre-adjustment dimming value DMV with the target dimming value, and may slowly change the adjusted dimming value DMV' such that the target dimming value is reached after a predetermined conversion time.

The adjusted dimming value DMV' may be converted into an adjusted dimming control signal DMS' by the dimming output unit 350 and then output to the backlight driving device. The pre-adjustment dimming control signal DMS and the adjusted dimming control signal DMS' are preferably of the same signal type. To this end, the dimming output unit 350 may control the PWM cycle or frequency of the adjusted dimming control signal DMS' so as to match with the PWM cycle or frequency of the pre-adjustment dimming control signal.

The gamma conversion unit 320 may calculate at least one characteristic value constituting a gamma curve according to the adjusted dimming value DMV', and may generate converted image data RGB' regarding the original image data RGB by using the gamma curve.

The data output unit 360 may output the converted image data RGB' to a data driving device configured to drive multiple pixels.

Figure 4:
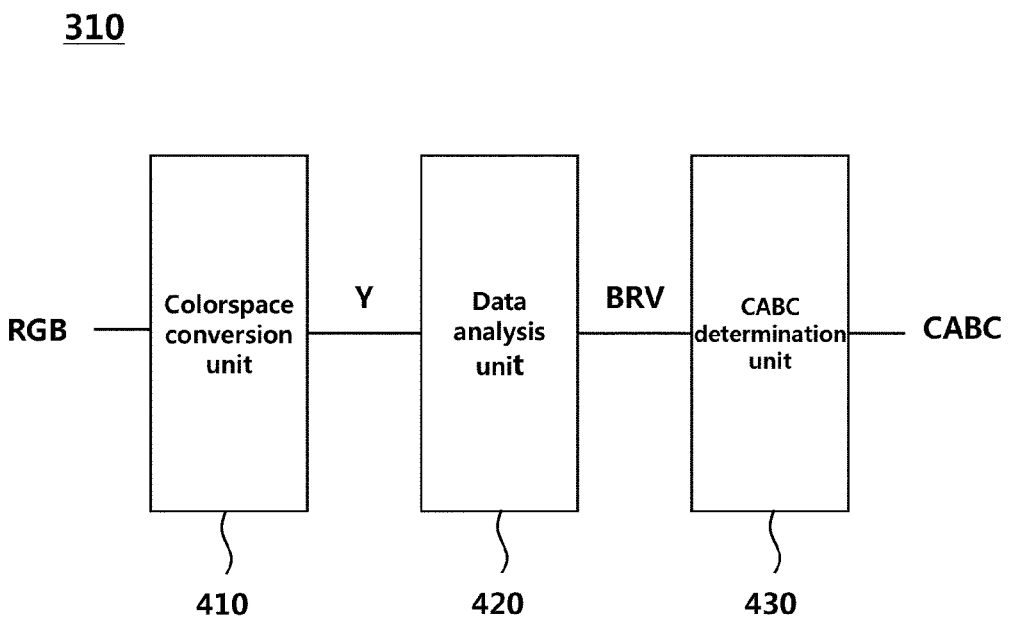
FIG. 4 is a diagram illustrating the configuration of an image analysis unit according to an embodiment.

FIG. 4 is a diagram illustrating the configuration of an image analysis unit according to an embodiment.

Referring to FIG. 4, the image analysis unit 310 may include a colorspace conversion unit 410, a data analysis unit 420, a CABC determination unit 430, and the like.

The colorspace conversion unit 410 may convert the colorspace of the original image data RGB. For example, the colorspace conversion unit 410 may convert original image data RGB in the RGB colorspace into a YUV colorspace. The colorspace conversion unit 410 may calculate the Y component of the YUV colorspace through an analysis of the original image data RGB.

As another example, the colorspace conversion unit 410 may calculate the Y component by converting the original image data RGB in the RFG colorspace into a colorspace having a weight G component. Specifically, the colorspace conversion unit 410 may calculate the Y component from a colorspace in which the G component thereof is given a weight twice the weight given to the R component and the B component.

In the above-mentioned example, the Y component may be understood as a pixel brightness value. When a single pixel includes multiple subpixels (R, G, B, and the like), the Y component corresponding to the pixel brightness value may be understood as the average brightness of respective subpixels.

As another example, the colorspace conversion unit 410 may calculate the maximum brightness value of each pixel instead of the Y component.

The data analysis unit 420 may calculate the representative brightness value BRV of multiple pixels according to the value of the Y component or the maximum brightness value of respective pixels, and the CABC determination unit 430 may determine a CABC value CABC suitable for the user's configuration on the basis of the representative brightness value BRV of the multiple pixels. The CABC value CABC may be the same value as the representative brightness value BRV or may be a value obtained by modifying the representative brightness value BRV. The CABC value CABC may be the same value as the representative brightness value BRV or may be a different type of value that the dimming control unit can recognize.

The CABC value CABC may differ according to the user's configuration even for the same representative brightness value BRV. For example, in the case of a configuration focused more on power saving than on image quality, the CABC value CABC may be determined to be relatively lower.

The data analysis unit 420 may calculate the representative brightness value by using a cumulated density function (CDF) or average pixel level (APL) method.

Figure 5:
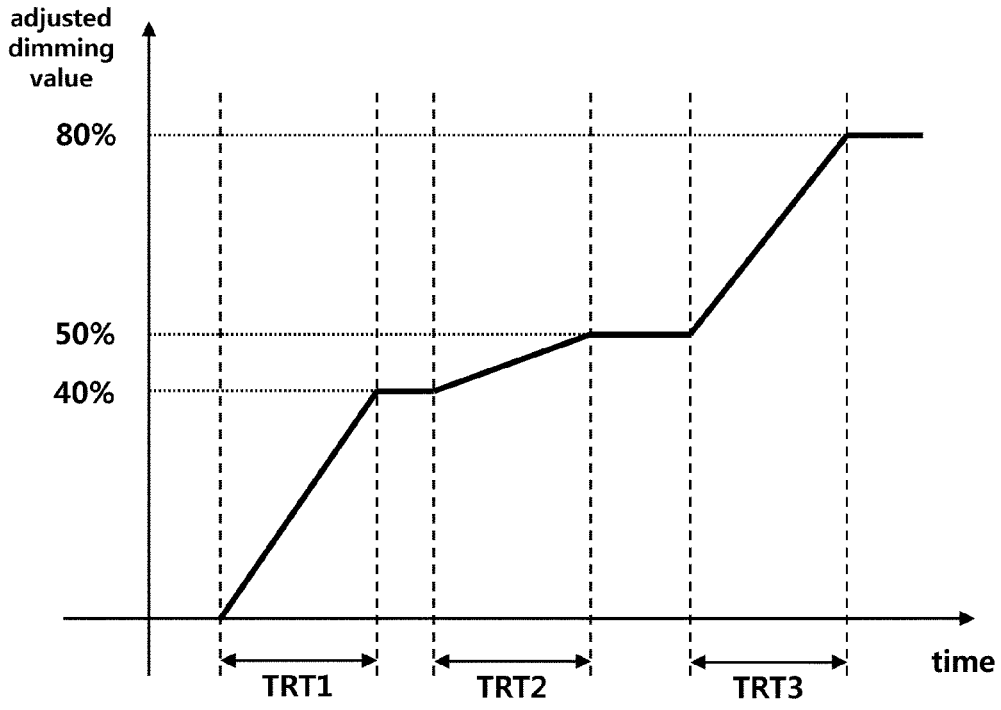
FIG. 5 is a graph illustrating a first example of changing a dimming value according to an embodiment.

FIG. 5 is a graph illustrating a first example of changing a dimming value according to an embodiment.

Referring to FIG. 5, the dimming control unit may calculate a target dimming value according to the representative brightness value or a modified value thereof, and may slowly change the adjusted dimming value such that the target dimming value is reached after predetermined conversion times TRT1, TRT2, and TRT3.

For example, the dimming control unit may slowly increase the adjusted dimming value such that the dimming value of the backlight reaches the first target dimming value (40%) for the first conversion time TRT1. If there is no change in the target dimming value after the first conversion time TRT1, the dimming control unit may maintain the adjusted dimming value as the first target dimming value. If the target dimming value is changed to a second target dimming value (50%), the dimming control unit may slowly increase the adjusted dimming value at a predetermined inclination for the second conversion time TRT2 such that the dimming value reaches the second target dimming value after the second conversion time TRT2 has passed. In addition, if there is no change in the target dimming value after the second conversion time TRT2, the dimming control unit may maintain the adjusted dimming value as the second target dimming value. If the target dimming value is changed to a third target dimming value (80%), the dimming control unit may slowly increase the adjusted dimming value at another predetermined inclination for the third conversion time TRT3 such that the dimming value reaches the third target dimming value after the third conversion time TRT3 has passed.

Figure 6:
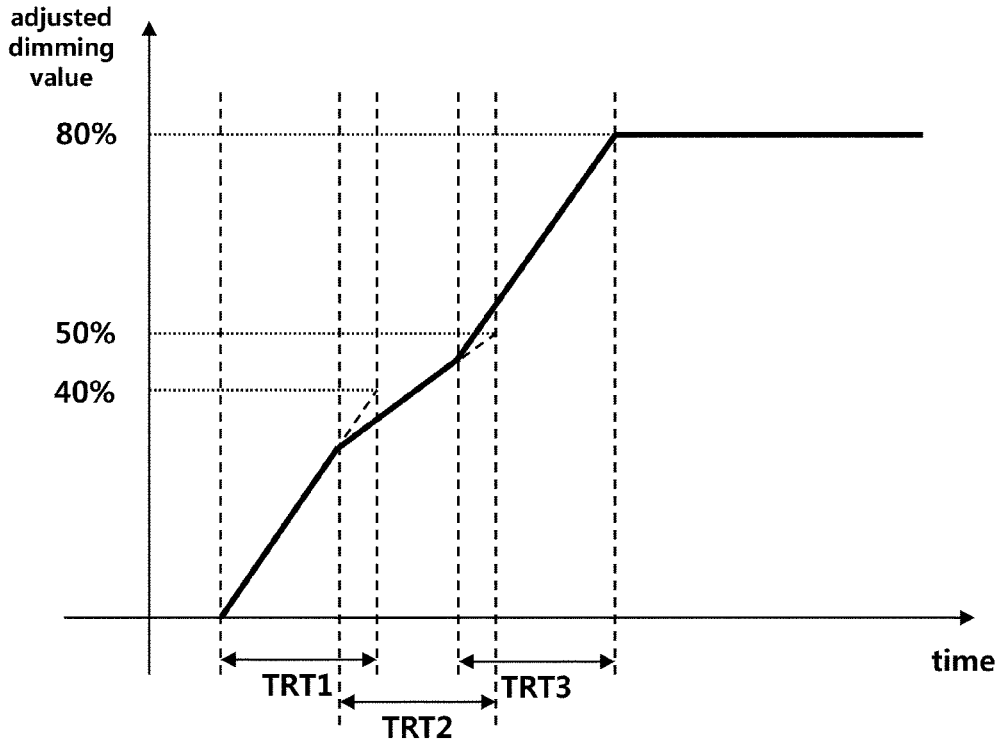
FIG. 6 is a graph illustrating a second example of changing a dimming value according to an embodiment.

FIG. 6 is a graph illustrating a second example of changing a dimming value according to an embodiment.

Referring to FIG. 6, if the target dimming value is changed before the adjusted dimming value reaches the target dimming value, the dimming control unit may change the rate of increase/decrease of the dimming value such that the adjusted dimming value reaches the new target dimming value during conversion times TRT1, TRT2, and TRT3.

For example, the dimming control unit may slowly increase the adjusted dimming value such that the dimming value of the backlight reaches the first target dimming value (40%) for the first conversion time TRT1. If the first target dimming value is changed to a second target dimming value (50%) before the first conversion time TRT1 passes, the dimming control unit may change the rate of change (inclination) of the dimming value such that the adjusted dimming value reaches the second target dimming value for the second conversion time TRT2 from the timepoint of change of the target dimming value. If the second target dimming value is changed to a third target dimming value (80%) before the second conversion time TRT2 passes, the dimming control unit may change the rate of change (inclination) of the dimming value such that the adjusted dimming value reaches the third target dimming value for the third conversion time TRT3 from the timepoint of change of the target dimming value.

Although examples of the dimming control unit successively controlling the dimming value of the backlight have been described with reference to FIG. 5 and FIG. 6, the dimming control unit may control the dimming value in a non-successive manner in other embodiments. For example, the dimming control unit may control the dimming value of the backlight by quickly changing the dimming value in the first half of a conversion time and then slowly changing the dimming value in the second half of the conversion time. As another example, the dimming control unit may control the dimming value of the backlight by slowly changing the dimming value in the first half of a conversion time and then quickly changing the dimming value in the second half of the conversion time.

Figure 7:
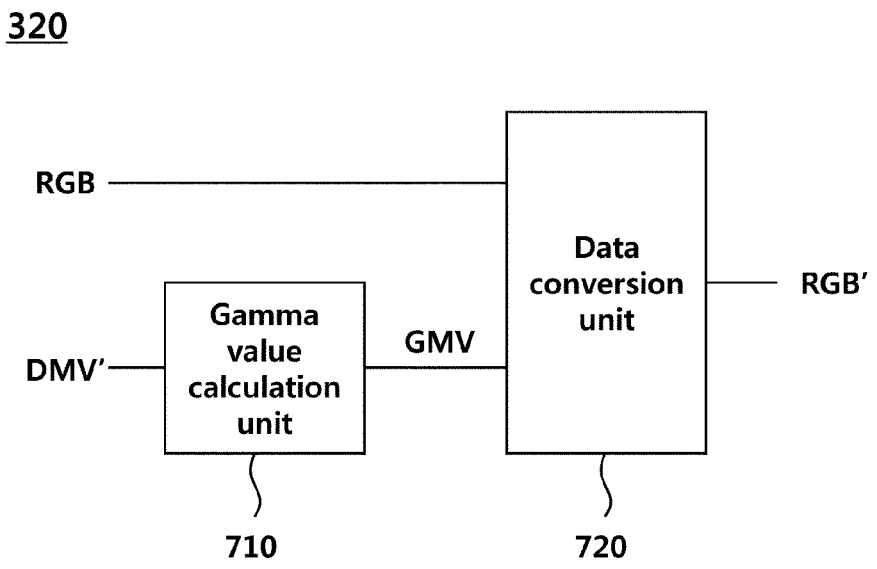
FIG. 7 is a diagram illustrating the configuration of a gamma conversion unit according to an embodiment.
Figure 8:
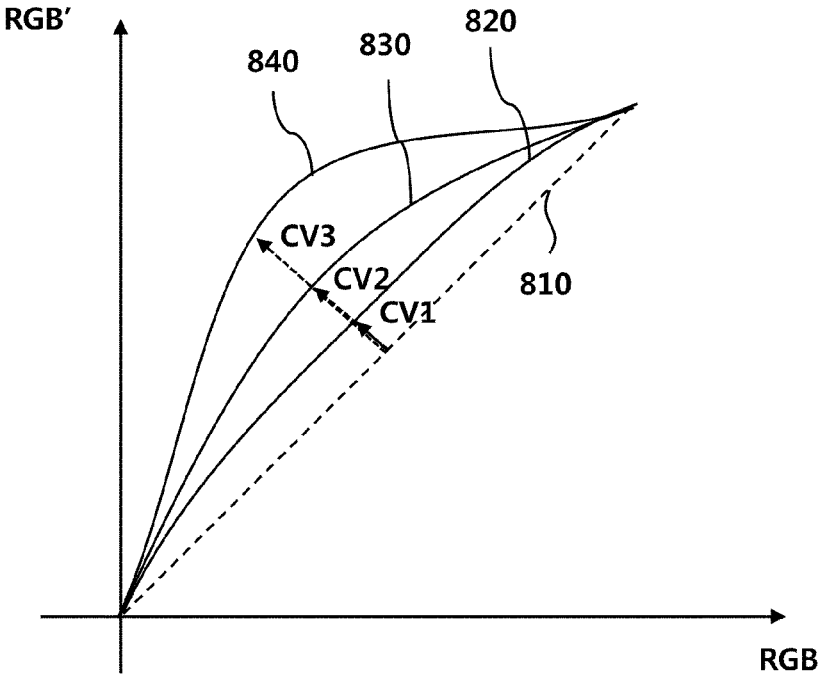
FIG. 8 is a first exemplary graph illustrating a gamma curve and a characteristic value according to an embodiment.
Figure 9:
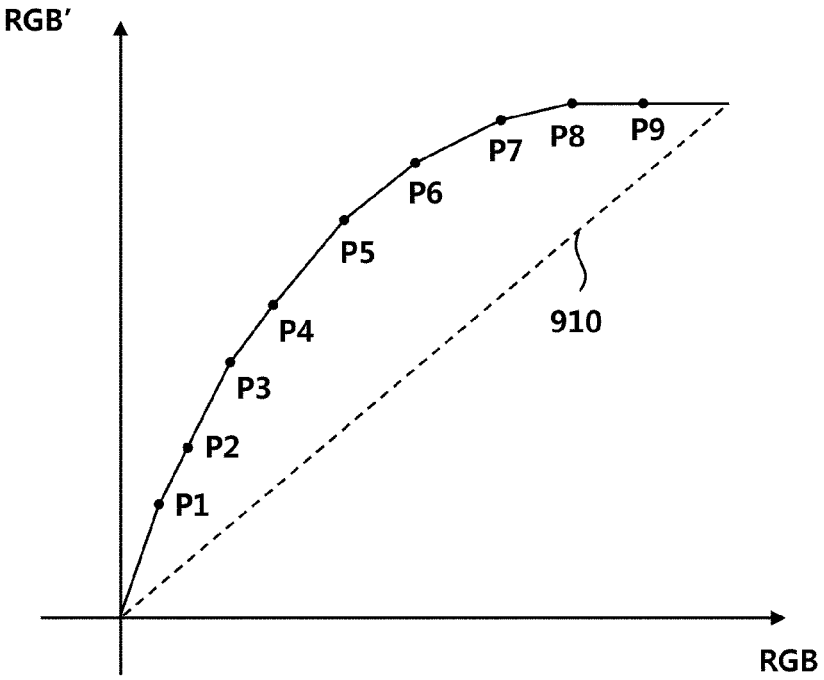
FIG. 9 is a second exemplary graph illustrating a gamma curve and a characteristic value according to an embodiment.

FIG. 7 is a diagram illustrating the configuration of a gamma conversion unit according to an embodiment. FIG. 8 is a first exemplary graph illustrating a gamma curve and a characteristic value according to an embodiment. FIG. 9 is a second exemplary graph illustrating a gamma curve and a characteristic value according to an embodiment.

Referring to FIG. 7, the gamma conversion unit 320 may include a gamma calculation unit 710, a data conversion unit 720, and the like.

The gamma calculation unit 710 may receive an adjusted dimming value DMV' and may generate at least one characteristic value GMV according to the adjusted dimming value DMV'.

The data conversion unit 720 may convert original image data RGB into converted image data RGB' by using a gamma curve specified by the at least one characteristic value GMV.

Further referring to FIG. 8, the at least one characteristic value GMV may be a value corresponding to a curvature.

The data conversion unit 720 may generate a gamma curve by using a curvature. For example, in the coordinate plane of RGB (original image data) and RGB' (converted image data), the data conversion unit 720 may fix both end points (a point corresponding to the smallest value of the grayscale of RGB and a point corresponding to the largest value thereof) with reference to the one-to-one straight line 810, and may generate gamma curves 820, 830, and 840 having curvatures determined by the degrees of spacing CV1, CV2, and CV3 from the one-to-one straight line 810.

Further referring to FIG. 9, the at least one characteristic value GMV may be coordinate values P1-P9 of major inflection points of a gamma curve 910. The gamma curve 910 may be a straight line or a curved line connecting the coordinate values P1-P9.

The data conversion unit 720 may have multiple characteristic value sets corresponding to multiple reference dimming values stored therein, and may calculate characteristic values GMV corresponding to major inflection points of a gamma curve by applying an interpolation formula to the multiple reference dimming values and the multiple characteristic value sets.

For example, if the adjusted dimming value DMV' corresponds to the first reference dimming value among the multiple reference dimming values, the data conversion unit 720 may select the first characteristic value set corresponding to the first reference dimming value, and may generate a gamma curve 910 on the basis of characteristic values GMV constituting the first characteristic value set. If the adjusted dimming value DMV' is different from the multiple reference dimming values, the data conversion unit 720 may select two reference dimming values close to the adjusted dimming value DMV' from the multiple reference dimming values, and may select two characteristic value sets corresponding to the two reference dimming values. The data conversion unit 720 may calculate interpolated characteristic values from the two characteristic value sets by using interpolation, and may generate a gamma curve 910 on the basis of the calculated characteristic values.

Nine characteristic values P1-P9 may be used with regard to the single gamma curve 910. The data conversion unit 720 may generate a gamma curve by connecting both end points of the one-to-one straight line 810 and the nine calculated characteristic values P1-P9 (in FIG. 9).

The data conversion unit 720 may apply the original image data RGB to the generated gamma curve, thereby generating converted image data RGB'.

Although an example of using nine characteristic values has been described with reference to FIG. 9, characteristic values more than nine or characteristic values less than nine may be used in other embodiments.

A display device according to an embodiment has been described above. The display device can simplify the process of converting image data in connection with the CABC technology, thereby reducing the amount of power consumed for CABC processing.

What is claimed is:

1. An image data processing device comprising:

an image analysis unit configured to calculate a representative brightness value of multiple pixels by analyzing original image data regarding the multiple pixels;

a dimming control unit configured to calculate an adjusted dimming value of a backlight according to the representative brightness value;

a gamma conversion unit configured to calculate at least one characteristic value constituting a gamma curve according to the adjusted dimming value and to generate converted image data regarding the original image data by using the gamma curve;

a data output unit configured to output the converted image data to a data driving device configured to drive the multiple pixels; and a dimming output unit configured to output an adjusted dimming control signal to a backlight driving device according to the adjusted dimming value, wherein the gamma conversion unit is configured to store multiple characteristic value sets corresponding to multiple reference dimming values and to calculate the at least one characteristic value corresponding to the adjusted dimming value by applying an interpolation formula to the multiple reference dimming values and the multiple characteristic value sets.

2. The image data processing device of claim 1, wherein the at least one characteristic value is coordinate values of major inflection points of the gamma curve, and the gamma curve consists of straight lines or curved lines connecting the coordinate values.

3. The image data processing device of claim 1, further comprising a dimming analysis unit configured to receive a pre-adjustment dimming control signal from outside and to check a pulse width modulation (PWM) cycle or frequency of the pre-adjustment dimming control signal, wherein the dimming output unit is configured to control a PWM cycle or frequency of the adjusted dimming control signal so as to match with the PWM cycle or frequency of the pre-adjustment dimming control signal.

4. The image data processing device of claim 1, wherein a lower the adjusted dimming value, a lower the brightness of the backlight, and a lower the adjusted dimming value, a larger a curvature of the gamma curve regarding the at least one characteristic value.

5. The image data processing device of claim 1, wherein the image analysis unit is configured to calculate a pixel brightness value having a weighted green (G) component through an analysis of the original image data and to calculate the representative brightness value according to the pixel brightness value.

6. The image data processing device of claim 5, wherein the image analysis unit is configured to calculate the representative brightness value by using a cumulated density function (CDF) or average pixel level (APL) method.

7. The image data processing device of claim 1, wherein the image analysis unit is configured to calculate a Y component (in a YUV colorspace) through an analysis of the original image data and to calculate the representative brightness value according to the value of the Y component.

8. A display device comprising:

a display panel having multiple pixels disposed thereon and having a backlight disposed in a background of the multiple pixels;

a data driving device configured to drive the multiple pixels;

a backlight driving device configured to drive the backlight and to control a dimming of the backlight; and an image data processing device configured to calculate a representative brightness value of the multiple pixels by analyzing original image data regarding the multiple pixels, to calculate an adjusted dimming value of the backlight according to the representative brightness value, to calculate at least one characteristic value constituting a gamma curve according to the adjusted dimming value, to generate converted image data regarding the original image data by using the gamma curve, to output the converted image data to the data driving device, and to output an adjusted dimming control signal to the backlight driving device according to the adjusted dimming value, wherein the image data processing device is configured to store multiple characteristic value sets corresponding to multiple reference dimming values and to calculate the at least one characteristic value corresponding to the adjusted dimming value by applying an interpolation formula to the multiple reference dimming values and the multiple characteristic value sets.

9. The display device of claim 8, wherein the backlight driving device is configured to perform a PWM dimming, and the adjusted dimming control signal is a PWM signal.

10. The display device of claim 8, further comprising a host device configured to transmit the original image data to the image data processing device and to transmit a pre-adjustment dimming control signal indicating a dimming value determined by user manipulation to the image data processing device.

11. The display device of claim 8, wherein the display panel comprises liquid crystals respectively corresponding to pixels and the data driving device is configured to control the brightness of each pixel by adjusting a direction of each liquid crystal.

12. The display device of claim 8, wherein the at least one characteristic value is a value corresponding to a curvature of the gamma curve.

13. An image data processing device comprising:

an image analysis unit configured to calculate a representative brightness value of multiple pixels by analyzing original image data regarding the multiple pixels;

a dimming control unit configured to calculate an adjusted dimming value of a backlight according to the representative brightness value;

a gamma conversion unit configured to calculate at least one characteristic value constituting a gamma curve according to the adjusted dimming value and to generate converted image data regarding the original image data by using the gamma curve;

a data output unit configured to output the converted image data to a data driving device configured to drive the multiple pixels; and a dimming output unit configured to output an adjusted dimming control signal to a backlight driving device according to the adjusted dimming value, wherein the dimming control unit is configured to calculate a target dimming value according to the representative brightness value and to slowly change the adjusted dimming value such that the target dimming value is reached after a predetermined conversion time, wherein the dimming control unit is configured to calculate a first target dimming value as the target dimming value and to change the adjusted dimming value at a first rate of change such that the first target dimming value is reached after the predetermined conversion time, and to change, if the target dimming value is changed to a second target dimming value before the first target dimming value is reached, the adjusted dimming value at a second rate of change such that the second target dimming value is reached after the predetermined conversion time from a timepoint of change.

* * * * *